US005924805A

United States Patent [19]

Belave et al.

[11] Patent Number: 5,924,805

[45] Date of Patent: Jul. 20, 1999

[54] PRINTER DEFINING A REDUCED EXTERIOR ENVELOPE THEREOF AND METHOD OF PROVIDING SAME

[75] Inventors: Paulina V. Belave, Champaign, Ill.; John D. DeLorme, Spencerport, N.Y.

[73] Assignee: Eastman Kodak Company, Rochester, N.Y.

[21] Appl. No.: 08/944,348

[22] Filed: Oct. 6, 1997

[51] Int. Cl.[6] ..... B41J 11/20; B41J 35/28

[52] U.S. Cl. ..... 400/120.01; 400/208; 400/650; 400/693.1; 347/214; 347/222

[58] Field of Search ..... 400/208, 207, 400/120.01, 650, 693.1; 347/214, 222

[56] References Cited

U.S. PATENT DOCUMENTS

| | | | |
|---|---|---|---|
| 4,917,513 | 4/1990 | Takanashi et al. | 400/208 |
| 5,230,574 | 7/1993 | Namekawa | 400/225 |
| 5,277,502 | 1/1994 | Kim | 400/196 |

*Primary Examiner*—Edgar Burr
*Assistant Examiner*—Daniel J. Colilla
*Attorney, Agent, or Firm*—Walter S. Stevens

[57] ABSTRACT

Printer defining a reduced exterior envelope and method of providing same. The printer comprises a housing having a top wall. The printer also has a front side wall with an aperture for receiving a dye-carrying cartridge therethrough. A printhead is disposed in the housing. A movable platen is disposed in the housing in a first position spaced-apart from the printhead and a movable arm attached to the platen and engageable with the cartridge as the cartridge is received through the aperture. The arm moves from a first location to a second location thereof as the arm engages the cartridge and the platen moves from the first position to a second position thereof adjacent the printhead as the arm moves from the first location to the second location. In this manner, the printer defines a reduced exterior envelope because the cartridge is loaded through the aperture in the front sidewall rather through the top wall of the printer. Also, when the platen is disposed in the first position thereof, it avoids creating an interference with the cartridge as the cartridge is inserted into the housing.

4 Claims, 3 Drawing Sheets

PRINTER DEFINING A REDUCED EXTERIOR ENVELOPE THEREOF AND METHOD OF PROVIDING SAME

FIELD OF THE INVENTION

This invention generally relates to printer apparatus and methods and more particularly relates to a printer defining a reduced exterior envelope thereof and method of providing same.

BACKGROUND OF THE INVENTION

A typical thermal printer has an enclosure for enclosing the components of the printer. Receiver medium is held in a supply tray at least partially insertable into the enclosure for supplying the receiver medium to a print head housed in the enclosure. A "picker" mechanism engages the receiver medium held in the supply tray and feeds the receiver medium to the print head. The receiver medium fed to the print head is brought into contact with a dye donor web carried by a dye donor cassette also insertable into the enclosure, the cassette capable of being disposed near the print head. The print head heat activates the dye donor web to transfer the dye to the receiver medium in order to print an output image on the receiver medium. The enclosure and the supply tray define an exterior envelope of the printer.

The dye donor cassette is usually inserted into the printer by opening a top panel of the printer and lowering the dye donor cassette into position in the printer. However, such printers are often placed in a confined space with limited head room. For example, such printers are often placed on shelves, wherein the floor of an adjacent upper shelf forms a relatively low ceiling above the top panel of the printer. Thus, this ceiling creates an interference or obstruction to opening the top panel. This makes loading the dye donor cassette difficult and time-consuming because the printer first must be removed from the shelf in order to open the top panel before loading the dye donor cartridge into the printer.

Front loading printers are known. A compact printer body capable of accepting an ink film and printing papers device into a receiving hole provided at the front face of the printer body is disclosed in U.S. Pat. No. 5,277,502 titled "Device For Loading Ink Film And Printing Papers In Color Video Printer" issued Jan. 11, 1994 in the name of Jae S. Kim. More specifically, this patent discloses a device having combined ink film and printing papers therein for combined loading of the ink film and printing papers into the color video printer. According to this patent, the device achieves a reduced size and thus results in compactness of the printer body. However, this combined ink film and printing papers device does not appear suitable for use where it is desired to feed printing papers and ink film independently and separately into the printer.

Therefore, there has been a long-felt need to provide a printer that obviates the need to load the dye donor cartridge by opening the top panel of the printer.

SUMMARY OF THE INVENTION

The invention resides in a printer comprising a housing having a front side wall having an aperture for receiving a dye-carrying cartridge therethrough. A printhead is disposed in the housing for activating the dye carried by the cartridge. A platen is disposed in the housing, the platen being movable from a first position spaced-apart from the cartridge to a second position near the cartridge as the cartridge is received through the aperture. An arm is attached to the platen for moving the platen from the first position to the second position.

An object of the present invention is to provide a printer defining a reduced exterior envelope thereof.

A feature of the present invention is the provision of an arm that moves the platen from the first position to the second position as the arm engages the cartridge that is being inserted through the aperture formed in the front side wall of the printer.

An advantage of the present invention is that the printer has a reduced exterior envelope such that a dye-carrying cartridge may be loaded therein through the front side wall rather than through a top panel in order that the printer may reside within a confined a space.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the detailed description of the preferred embodiments of the invention presented hereinbelow, reference is made to the accompanying drawings, in which.

DETAILED DESCRIPTION OF THE INVENTION

The present description is directed in particular to elements forming part of, or cooperating more directly with, apparatus in accordance with the present invention. It is to be understood that elements not specifically shown or described may take various forms well known to those skilled in the art.

Figure 1:
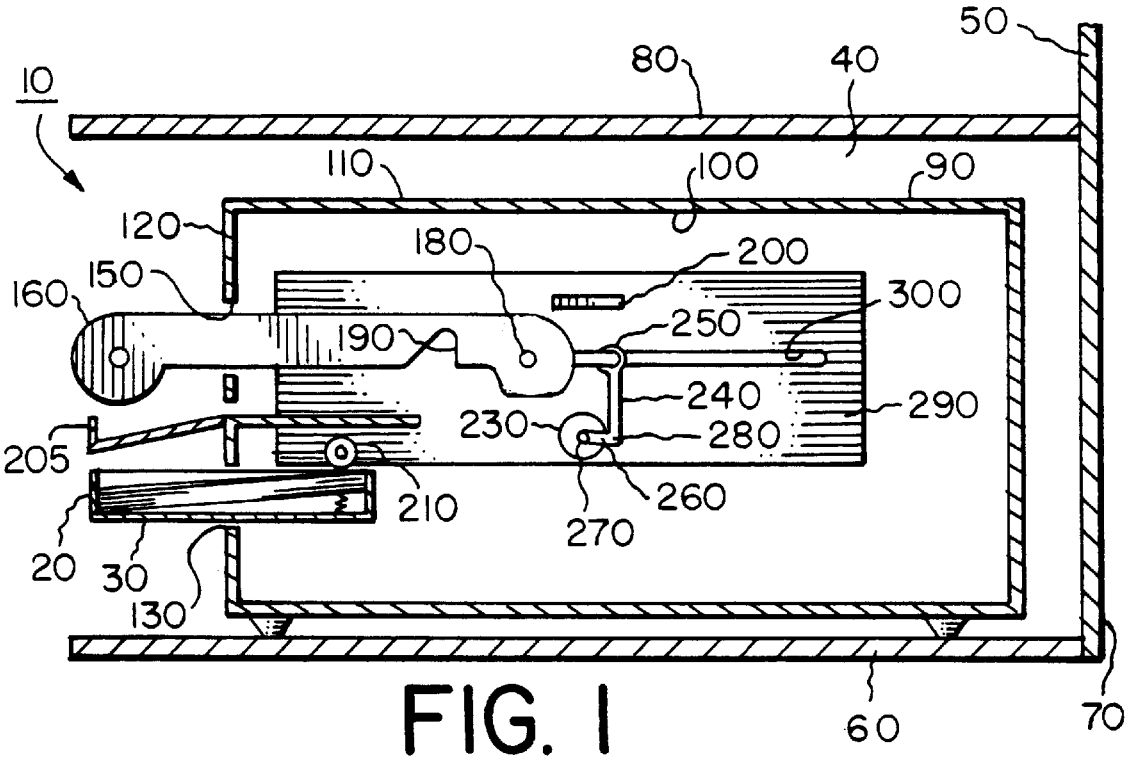
FIG. 1 is a view in elevation of a thermal printer with parts removed for clarity, the printer having a housing defining a reduced exterior envelope thereof for disposing the printer in a confined space.

Referring to FIG. 1, there is shown a printer, such as a thermal printer, generally referred to as 10, for printing an image on a dye receiver 20, which receiver 20 may be a plurality of cut sheets of coated paper or transparency fed from a receiver medium supply tray 30. As described more fully hereinbelow, printer 10 has a reduced exterior envelope so that printer 10 may be placed in a confined space 40, such as defined by a shelf structure 50 bounded by a floor 60, a rear wall 70 and a relatively low ceiling 80 overhanging printer 10.

Figure 2:
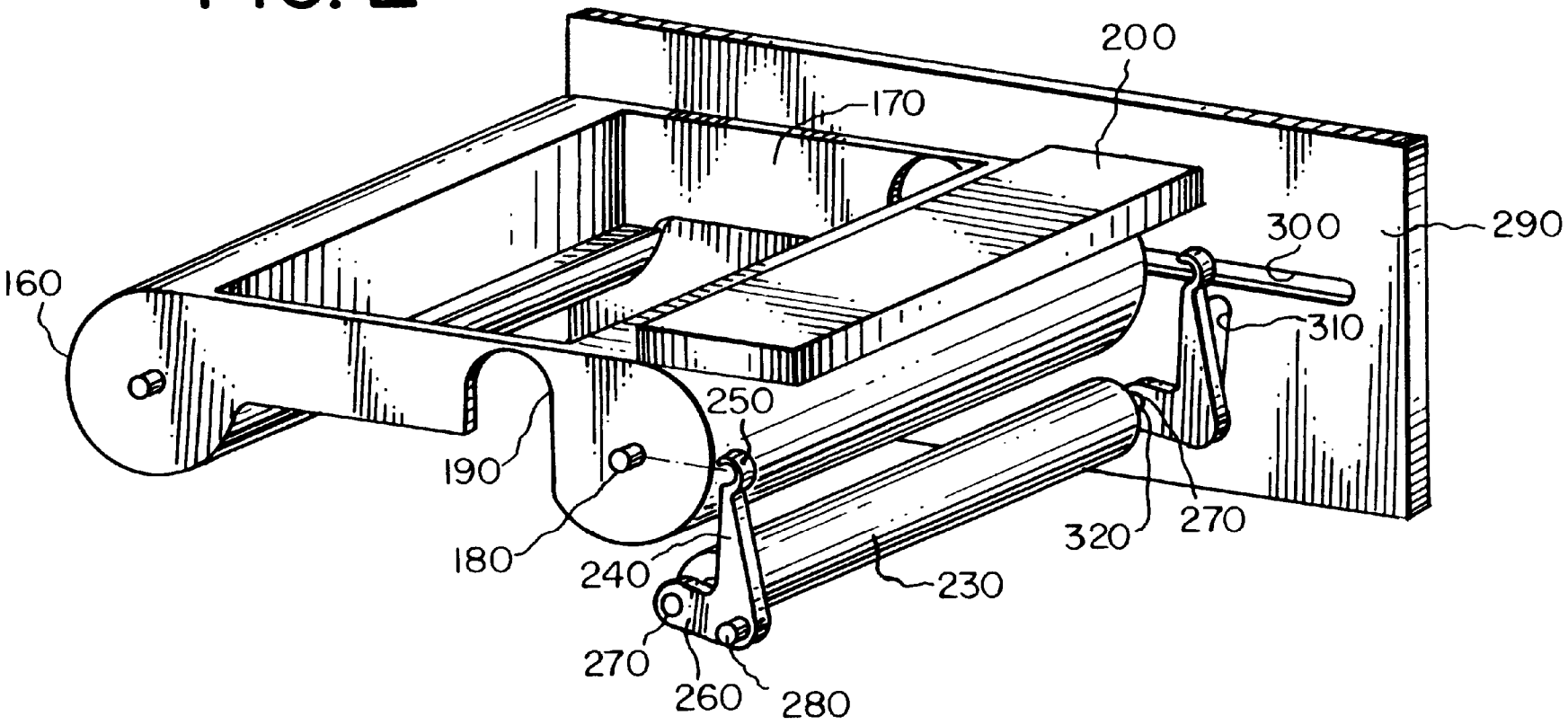
FIG. 2 is a perspective view of a dye donor cartridge and nearby printhead, this view also showing an arm and attached platen roller, which platen roller is disposed in a first position.

Referring to FIGS. 1 and 2, printer 10 comprises a housing 90 defining an exterior envelope thereabout and an interior 100 therein. Housing 90 includes a top wall 110 and a front sidewall 120, front sidewall 120 having an opening 130 sized to receive supply tray 30 at least partially insertable therethrough. Also formed through front sidewall 120 is an aperture 150 for receiving a dye-carrying dye donor supply cartridge 160. In this regard, cartridge 160 carries a thermally activatable dye donor web 170, as shown in phantom in FIG. 2. Cartridge 160 includes an outwardly projecting post 180 and a recess 190 for reasons disclosed hereinbelow. Moreover, disposed in housing 90 is a thermal printhead 200 for thermally activating dye donor web 170 in order to transfer dye therein onto each of sheets 20. In this regard, thermal print head 200 is formed of a plurality of individual resistive heating elements (not shown) such that when a particular heating element is energized, its heat causes dye from dye donor web 170 to transfer to receiver medium 20 for forming an image thereon. Printer 10 may also include an output tray assembly 205 for receiving receiver medium 20 after the image is formed on receiver medium 20. Moreover, a picker roller 210 is disposed in housing 90 for separately urging each sheet of receiver medium 20 into a nip area 220 (see FIG. 3) defined between print head 200 and a movable platen roller 230 disposed in housing 90.

Referring again to FIGS. 1 and 2, printer 10 further comprises a movable arm 240 having an arcuate-shaped first portion 250 sized to accept post 180 as cartridge is received through aperture 150. Arm 240 also has a second portion 260 thereof connected to platen roller 230, as by an axle 270. Axle 270 is capable of engaging recess 190 for locking arm 240 to cartridge 160 once cartridge 160 is properly positioned in housing 90 near printhead 200. Moreover, integrally attached to second portion 260 of arm 240 is an outwardly projecting guide pin 280 for reasons provided hereinbelow.

Still referring to FIGS. 1 and 2, disposed in housing 90 is a frame 290 having an elongate first slot 300 therein for slidably receiving post 180 as cartridge 160 is received through aperture 150. In this manner, frame 290 and first slot 300 formed therein serve to guide cartridge 160 into housing 90 as cartridge 160 is received into housing 90. In addition, frame 290 also includes a second slot 310 preferably oriented generally perpendicularly or even angularly with respect to the orientation of first slot 300 for slidably receiving pin 280, as described more fully hereinbelow.

Figure 4:
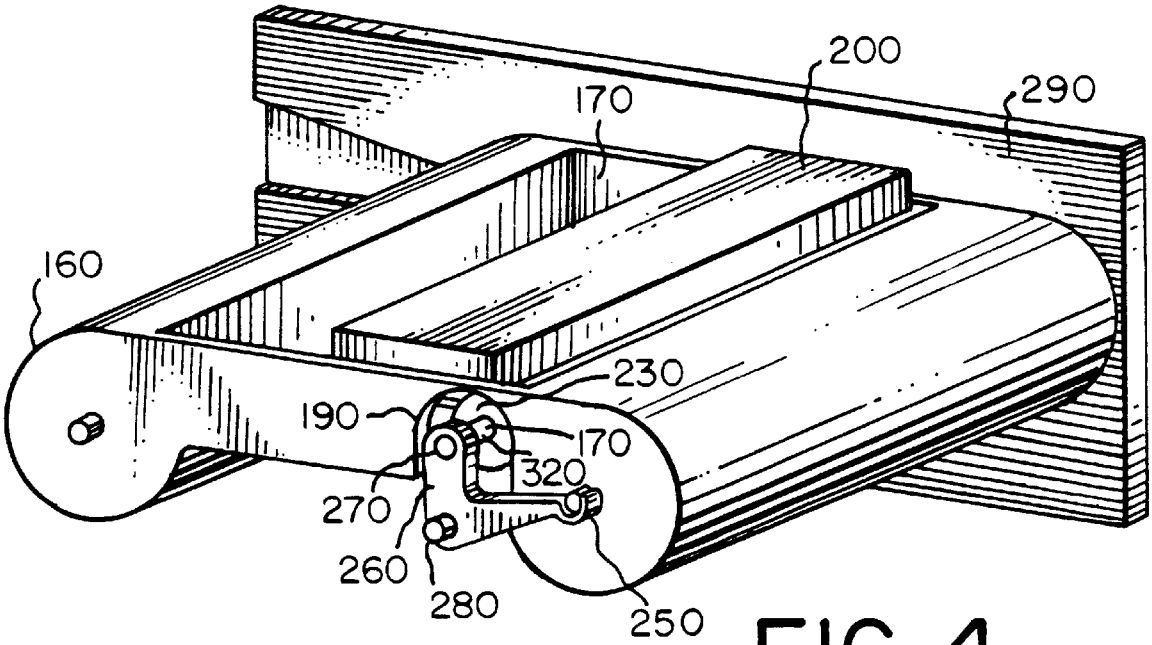
FIG. 4 is a view in perspective of the arm and attached platen roller having moved to the second position.
Figure 3:
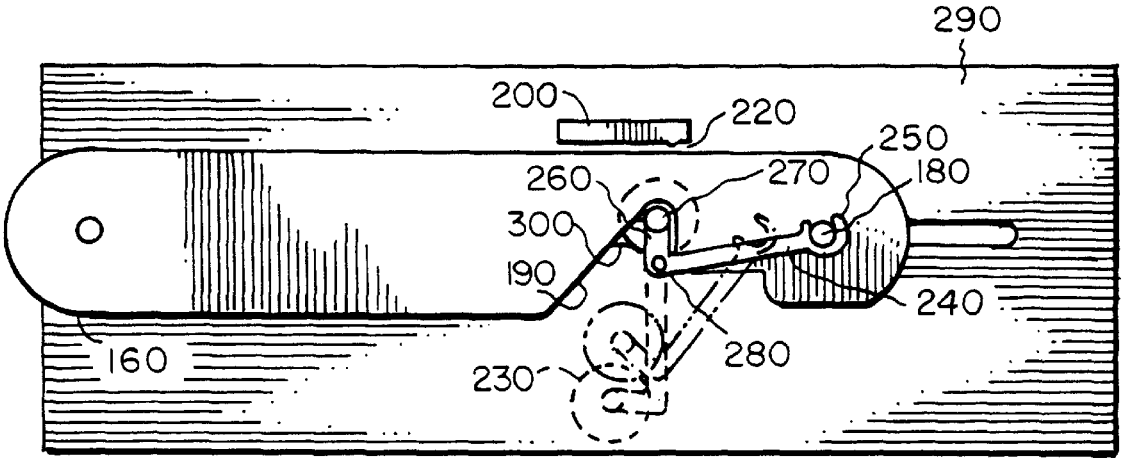
FIG. 3 is a view in elevation of the arm and attached platen roller moving from the first position to a second position.
Figure 5:
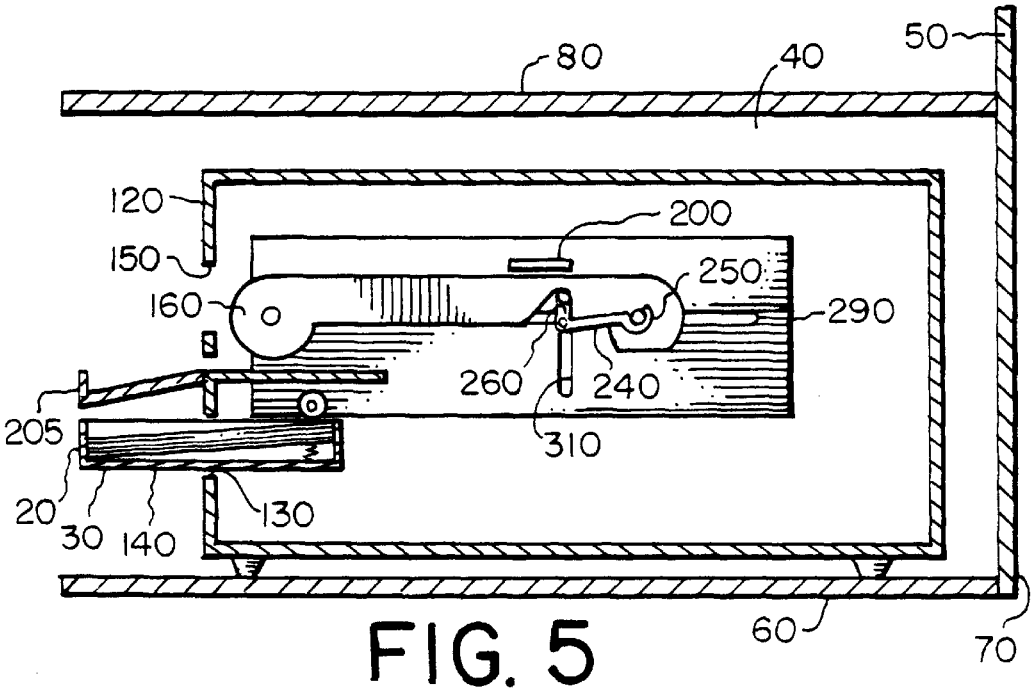
FIG. 5 is a view in elevation of the arm and attached platen roller having moved to the second position.

Referring now to FIGS. 3, 4 and 5, when cartridge 160 is received through aperture 80, such as being manually pushed therethrough by an operator of printer 10, post 180 of cartridge 160 slides in first slot 300. As post 180 slides in first slot 300, first portion 250 of arm 240 engages post 180. As first portion 250 engages post 180, arm 240 rotatably moves from a first location to a second location, as shown in phantom in FIG. 3. As arm 240 moves from the first location to the second location thereof, guide pin 280 slides in second slot 310. However, before guide pin 280 slides in second slot 310, platen roller 230 is initially disposed in a first position, such that platen roller 230 is spaced-apart from print head 200. Next, platen roller 130 moves from its first position to a second position adjacent print head 200 as guide pin 180 slides in second slot 310. It is appreciated from the description hereinabove that movable arm 240 locates platen roller 230 in a first position out of the way of cartridge 160 as cartridge 160 is slidably inserted into position adjacent printhead 200. In this manner, platen roller 230 does not interfere with cartridge 160. Moreover, it is appreciated from the description hereinabove, that arm 240 moves platen roller 200 into the second position near cartridge 160 only when cartridge 160 has been inserted into its proper position adjacent printhead 200. It is further appreciated that when platen roller 200 moves to its second position, an end portion 320 of axle 170 is received in recess 190 to lock platen roller to cartridge 160. Thus, it is important that platen roller 200 be able to move form its first position to its second position. This is important because platen roller 200 would otherwise interfere with the free movement of cassette 160 as cassette 160 is inserted into housing 90. More specifically, platen roller 200 is movable so that platen roller 200 moves out of the way of cassette 160 as cassette 160 is inserted into housing 90 and moves to near cassette 160 once cassette 160 is properly positioned in housing 90.

An advantage of the present invention is that dye donor cartridge 160 may be loaded into printer 10 as printer 10 resides within confined space 40. This is so because dye donor cartridge 160 is loaded through front side wall 120 rather than being loaded by means of opening top wall 110. Loading dye donor cartridge 160 by opening top wall 110 is undesirable because ceiling 80 creates an interference or obstruction necessitating removal of printer 10 from space 40 to gain access to interior 100 of printer 10. Thus, the configuration of printer 10 described herein reduces the exterior envelope of printer 10 by avoiding opening of top wall 110. This is so because opening of top wall 110 would otherwise expand the exterior envelope of printer 10.

The invention has been described in detail with particular reference to certain preferred embodiments thereof, but it will be understood that variations and modifications can be effected within the spirit and scope of the invention. For example, the second end portion of the arm may be provided with a releasable locking mechanism or releasable catch to releasably lock the platen roller to the dye donor cartridge.

Therefore, what is provided is a printer that obviates the need to load the dye donor cartridge by opening the top panel of the printer. PARTS LIST

10 . . . printer
20 . . . dye receiver
30 . . . supply tray
40 . . . confined space
50 . . . shelf structure
60 . . . floor
70 . . . rear wall
80 . . . ceiling
90 . . . housing
100 . . . interior
110 . . . top wall
120 . . . front sidewall
130 . . . opening
150 . . . aperture
160 . . . dye donor cartridge
170 . . . dye donor web
180 . . . post
190 . . . recess
200 . . . printhead
205 . . . output tray
210 . . . picker roller
220 . . . nip area
230 . . . platen roller
240 . . . arm
250 . . . first portion of arm
260 . . . second portion of arm
270 . . . axle
280 . . . guide pin
290 . . . frame
300 . . . first slot
310 . . . second slot
320 . . . end portion of axle

What is claimed is:

1. A printer defining a reduced exterior envelope thereof, comprising:

(a) a dye-carring cartridge, said cartridge having a recess therein and an outwardly projecting guide post:

(b) a housing having a front wall having an aperture for receiving said dye-carrying cartridge therethrough;

(c) a printhead disposed in said housing for activating the dye carried by the cartridge;

(d) a frame disposed in said housing, the frame having a first slot slidably engageable with the post for guiding the cartridge into said housing, said frame having a second slot therein;

(e) a platen disposed in said housing;

(f) a movable arm having a first portion thereof engageable with the post and a second portion thereof connected to said platen for moving said platen from a first position spaced-apart from said cartridge to a second position near said cartridge as said cartridge is received through the aperture as the first portion of the arm engages the post, said arm having a guide pin outwardly projecting therefrom and slidably engaging the second slot for guiding said platen into engagement with the recess to lock said platen in the second position, whereby the post slidably engages the first slot as the cartridge is received through the aperture, whereby the first portion of said arm engages the post as the post engages the first slot, whereby the first portion of said arm moves as the first portion of said arm engages the post, whereby the second portion of said arm moves as the first portion of said arm moves, whereby the pin slides in the second slot as the second portion of said arm moves, whereby said platen moves from the first position to the second position as the pin slides in the second slot, whereby said platen engages the recess as the pin reaches the terminus of the second slot, whereby said platen locks to the cartridge as the pin engages the recess, and whereby said housing defines an exterior envelope of predetermined volume as the cartridge is received through the aperture.

2. The printer of claim 1, wherein said printhead is a thermal printhead.

3. A method of providing a printer defining a reduced exterior envelope thereof, comprising the steps of:

(a) providing a dye-carrying cartridge, the cartridge having a recess therein and an outwardly projecting guide post;

(b) providing a housing having a front wall having an aperture for receiving the dye-carrying cartridge therethrough;

(c) providing a printhead disposed in the housing for activating the dye carried by the cartridge;

(d) providing a frame disposed in the housing, the frame having a first slot slidably engageable with the post for guiding the cartridge into the housing, the frame having a second slot therein;

(e) providing a platen disposed in the housing, the platen being movable from a first position spaced-apart from the cartridge to a second position near the cartridge;

(f) providing a movable arm having a first portion thereof engageable with the post and a second portion thereof connected to the platen for moving the platen from the first position to the second position as the first portion of the arm engages the post, the arm having a guide pin outwardly projecting therefrom and slidably engaging the second slot for guiding the platen into engagement with the recess to lock the platen in the second position, so that the housing defines an exterior envelope of predetermined volume as the cartridge is received through the aperture.

4. The method of claim 3, wherein the step of providing a printhead comprises the step of providing a thermal printhead.

* * * * *